United States Patent [19]

Lilley

[11] Patent Number: 4,848,457

[45] Date of Patent: Jul. 18, 1989

[54] ANNULUS SLIDING SLEEVE VALVE

[75] Inventor: Robert O. Lilley, Aberdeen, Scotland

[73] Assignee: Vetco Gray Inc., Houston, Tex.

[21] Appl. No.: 189,890

[22] Filed: May 3, 1989

[51] Int. Cl.[4] ..... E21B 34/02

[52] U.S. Cl. ..... 166/87; 166/332

[58] Field of Search ..... 166/86, 87, 88, 89, 166/72, 332, 316

[56] References Cited

U.S. PATENT DOCUMENTS

| | | | |
|---|---|---|---|
| 3,032,111 | 5/1962 | Corley, Jr. et al. | 166/332 |
| 3,750,749 | 8/1973 | Giroux | 166/95 |
| 4,109,712 | 8/1978 | Regan | 166/87 |
| 4,125,155 | 11/1978 | Brock, Jr. | 166/97 |
| 4,333,526 | 6/1982 | Watkins | 166/87 |

*Primary Examiner*—Jerome W. Massie
*Assistant Examiner*—Terry Lee Melius
*Attorney, Agent, or Firm*—James E. Bradley

[57] ABSTRACT

An annulus valve for a well concentric tubing hanger has features to prevent damage to the seals. The annulus valve has a closure sleeve that when moved to an open position, communicates fluid from an annulus between casing and tubing to a point above the tubing hanger. The lower end of the closure sleeve slides above an annulus port located on the exterior of the tubing hanger. A protector sleeve located below the closure sleeve protects a seal located below the annulus port when the closure sleeve moves to the open position. The protector sleeve is urged upward by a spring into contact with the lower end of the annulus sleeve. The protector sleeve has a stop that prevents further upward movement of the protector sleeve once the upper edge of the protector sleeve reaches the lower edge of the annulus port. This allows the closure sleeve to separate from the annulus sleeve to open the port.

4 Claims, 2 Drawing Sheets

ANNULUS SLIDING SLEEVE VALVE

BACKGROUND OF THE INVENTION

1. Field of the Invention

This invention relates in general to oil well valves, and in particular to an annulus valve used below a tubing hanger in a subsea well.

2. Description of the Prior Art

In a producing oil well, a string of tubing will be suspended within casing. The tubing is suspended at the wellhead by a tubing hanger. Normally, a downhole packer will seal the tubing to the casing. The produced fluids flow through the tubing to the surface.

Periodically, the pressure in the annulus between the tubing and casing must be checked to determine if any leakage exists. Also, when workoever operations are being performed, it may be necessary to circulate fluids down the tubing and up the annulus. In a subsea well, the opening and closing of the annulus is preferably handled remotely.

Some tubing hangers for subsea wells have two parallel passages, one for the production fluid and one for the annulus. An external valve will control the annulus in those types. Each passage is offset from the axis of the tubing hanger. In the concentric tubing hanger type, the production fluid passage is centered on the axis of the tubing hanger. A sliding sleeve valve is mounted to the tubing hanger below the seals between the tubing hanger and wellhead. An annulus passage extends through the body of the tubing hanger from the top to a lower cylindrical portion formed on the tubing hanger.

The sliding sleeve is mounted to the lower cylindrical portion. The sliding sleeve has a port that will align with the annulus passage port in the tubing hanger to communicate the annulus to a point above the tubing hanger. Hydraulic pressure applied from the surface will move the sleeve down, and a spring will force the sleeve back up when hydraulic pressure is removed.

While this type of annulus valve is successful, a possibility for a problem exists. Elastomeric seals are located above and below the annulus port on the body of the tubing hanger. The port in the sliding sleeve slides past the lower seal as it moves between the open and closed position. There is a possibility of damage to the lower seal as the sliding sleeve port slides past the lower seal. If such occurred, the tubing hanger may have to be pulled from the wellhead to replace the seal.

SUMMARY OF THE INVENTION

The closure sleeve for the annulus valve of this invention does not have a hole or port that aligns with the port of the tubing hanger. Rather, the closure sleeve has a lower edge that moves above the port when the valve is moved to the upper position. The lower edge of the closure sleeve slides past the lower seal when moving between the open and closed position.

To protect the lower seal, a protector sleeve is slidingly mounted to the tubing hanger body. The protector sleeve has an upper edge that abuts the lower edge of the closure sleeve. A spring urges the protector sleeve upward into contact with the closure sleeve. As the closure sleeve moves up, the spring will cause the protector sleeve to move up with the closure sleeve. As the closure sleeve slides above the lower seal, the protector sleeve will slide over the lower seal to prevent damage to the lower seal.

A stop shoulder on the protector sleeve stops the protector sleeve from moving upward once the protector sleeve reaches the port on the tubing hanger body. The closure sleeve will continue to move upward, separating from the protector sleeve. As they separate, access to the annulus port will occur.

DESCRIPTION OF THE PREFERRED EMBODIMENT

Figure 1:
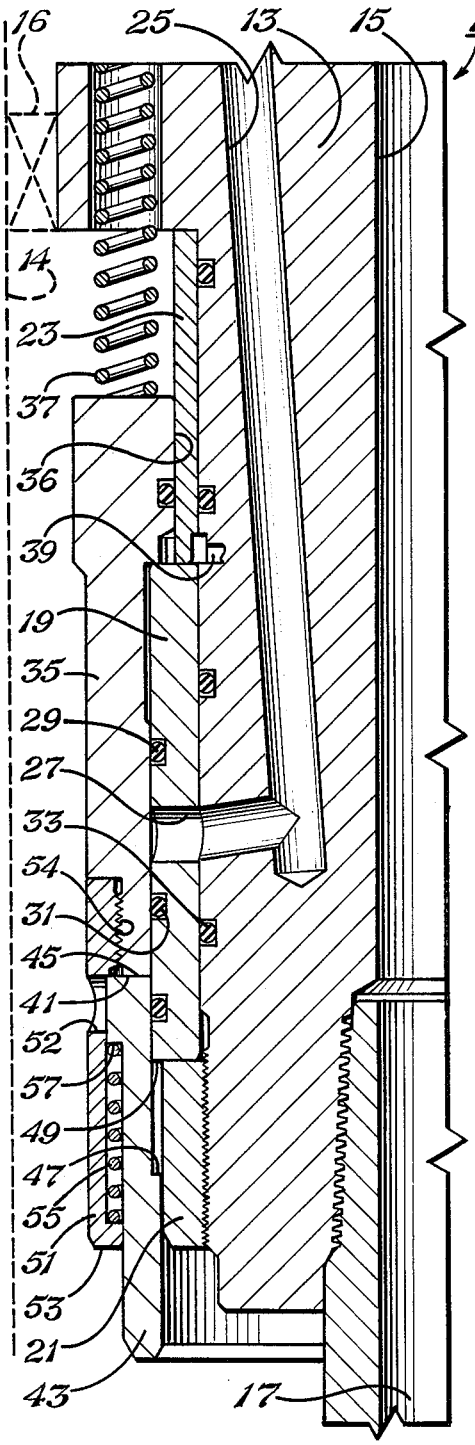
FIG. 1 is a partial vertical sectional view illustrating an annulus valve constructed in accordance with this invention.

Referring to FIG. 1, a portion of a subsea well tubing hanger 11 is shown. The tubing hanger 11 has a body 13. Tubing hanger 11 is mounted in a wellhead 14 above casing (not shown). Seals 16 seal the tubing hanger 11 to the wellhead 14. A string of tubing 17 is secured concentrically to the lower end of the tubing hanger body 13 and extends down into the well.

A fixed sleeve 19 is mounted to the lower portion of the tubing hanger 11. Fixed sleeve 19 has a cylindrical exterior. The fixed sleeve 19 is rigidly mounted to the body 13 by a retaining ring 21 on its lower end and a spacer sleeve 23 on its upper end. Fixed sleeve 19 may be considered a portion of the body 13.

A plurality of annulus passages 25 (only one shown) extend through the body 13. Each annulus passage 25 extends from an opening on the upper end (not shown) of the body 13 to a port 27 on the sidewall of the fixed sleeve 19. The port 27 is sealed by upper and lower seals 29, 31, preferably O-rings, which are located directly above and below the port 27. The O-rings 29, 31 extend completely around the sleeve 19. Another O-ring 33 is located below the lower O-ring 31.

Figure 2:
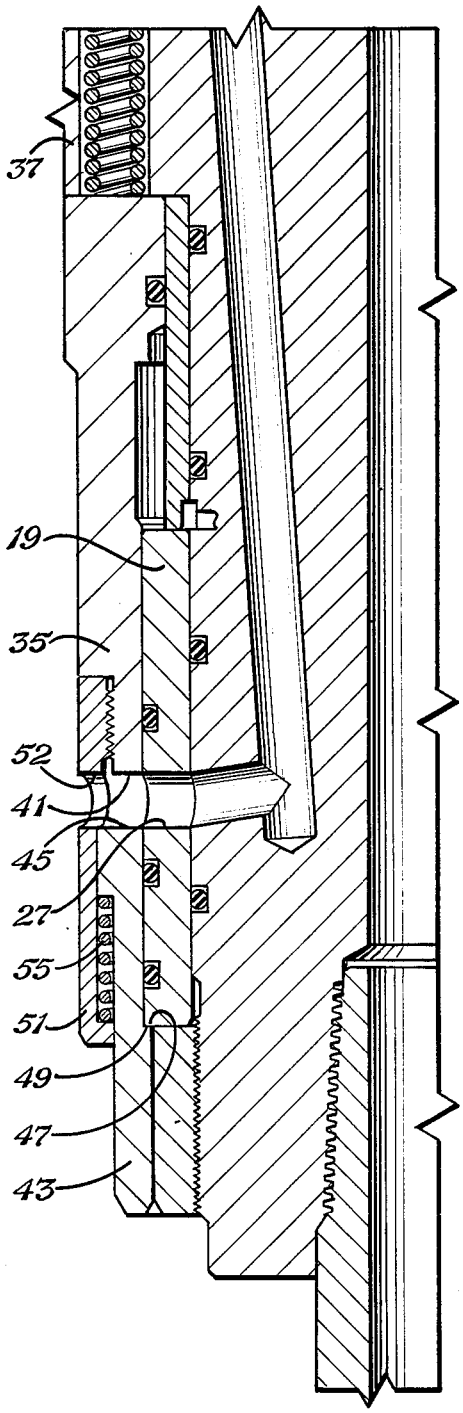
FIG. 2 is a sectional view of the annulus valve of FIG. 1, showing the valve in the upper open position.
Figure 3:
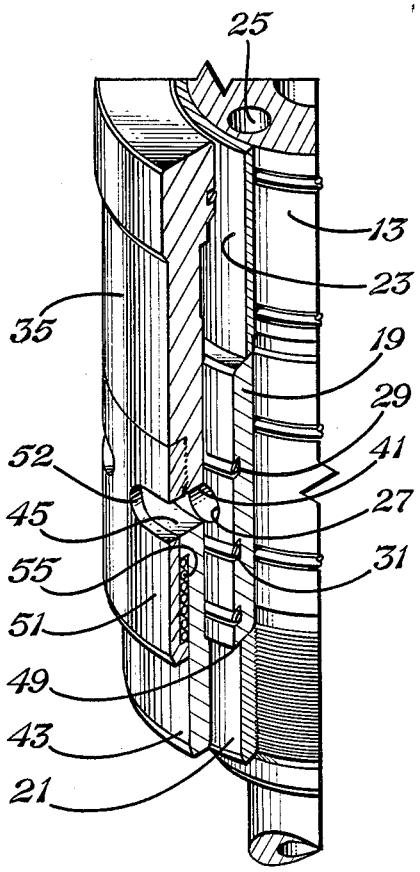
FIG. 3 is a partial perspective view illustrating the annulus valve of FIG. 1.

The annulus port 27 is opened and closed by a closure sleeve 35. Closure sleeve 35 is slidingly mounted to the fixed sleeve 19 and will move between an upper open position shown in FIG. 2 and a lower closed position shown in FIG. 1. An upper piston portion 36 of the closure sleeve 35 slides on the spacer 23. A plurality of coil springs 37 urge the closure sleeve 35 downward. A hydraulic passage 39, only partially shown, leads to a point on the top of the tubing hanger 11. The hydraulic passage 39 transmits hydraulic fluid through openings (not shown) in the spacer 23 to the piston area 36 to push the closure sleeve 35 upward, compressing the springs 37. Alternately, rather than springs 37 for moving the closure sleeve 35 downward, hydraulic pressure could move the closure sleeve 35 both upward and downward.

The closure sleeve 35 has a lower edge or rim 41. The lower edge 41 is circular and located in a plane perpendicular to the axis of the closure sleeve 35. Closure sleeve 35 is dimensioned so that the lower edge 41 will align with the upper edge of the annulus port 27 when the closure sleeve 35 is in the upper position shown in FIG. 2. When hydraulic pressure is removed from the hydraulic passages 39, the lower edge slides downward past the lower O-ring 31, blocking the annulus port 27.

A protector sleeve 43 is used to protect the lower O-ring 31 when the lower edge 41 of the closure sleeve 35 slides above the lower O-ring 31. The protector sleeve 43 is slidingly mounted to the fixed sleeve 19. It will move between an upper position shown in FIG. 2 and a lower position shown in FIG. 1. The protector sleeve 43 has a circular upper edge 45 that lies in a plane parallel with the lower edge 41 of the closure sleeve 35. The upper edge 45 will align with the lower edge of the annulus port 27 when protector sleeve 43 is in the upper position. The lower edge 41 of the closure sleeve 35 abuts the upper edge 45 of the protector sleeve 43 when the closure sleeve 35 and protector sleeve 43 are in the closed position. The edges 41, 45 are spaced apart from each other when the sleeves 35, 43 are in the open positions.

A stop means exists to stop upward movement of the protector sleeve 43 when the upper edge 45 aligns with the lower edge of the annulus port 27. This includes an upward facing interior shoulder 47 formed on the protector sleeve 43. Shoulder 47 engages a downward facing shoulder 49 on the tubing hanger 11, which in the embodiment shown, is a lower edge of the fixed sleeve 19. Alternately shoulder 49 could be located on the retaining ring 21. A portion of the protector sleeve 43 slides against the outer surface of the retaining ring 21.

Means also exists for urging the protector sleeve 43 upward. This includes an extension sleeve 51 which is rigidly mounted to the lower end of the closure sleeve 35 by threads 54. The extension sleeve 51 thus moves up and down with the closure sleeve 35. Extension sleeve 51 has a hole 52 that will align with the annulus port 27 when the closure sleeve 35 is in the upper position. An internal annular lip 53 is formed on the lower end of extension sleeve 51. A coil spring 55 is compressed between the lip 53 and an exterior downward facing shoulder 57. Shoulder 57 is formed on the exterior of the protector sleeve 43. Spring 55 maintains the upper edge 45 of the protector sleeve 43 in contact with the lower edge 41 of the closure sleeve 35, until the stop shoulders 47, 49 contact each other.

In operation, during normal production, the closure sleeve 35 will be closed. The springs 37 will keep the closure sleeve 35 in the lower position shown in FIG. 1. The spring 55 will keep the protector sleeve 43 in contact with the lower edge 41 of the closure sleeve 35.

When it is desired to open the annulus surrounding the tubing 17 to communication above the tubing hanger 11, hydraulic fluid pressure is applied to the passage 39. The fluid pressure acts on the piston portion 36 to begin moving the closure sleeve 35 upward. The spring 55 will cause the protector sleeve 43 to move upward in unison with the closure sleeve 35.

As the lower edge 41 of closure sleeve 35 slides above the lower O-ring 31, the upper edge 45 of the protector sleeve 43 will slide onto the O-ring 31. The protector sleeve 43 prevents any differential pressure between the annulus passage 25 and the annulus from damaging the O-ring 31 as the closure sleeve 35 disengages from the O-ring 31.

When the upper edge 45 of the protector sleeve 43 reaches the lower edge of the annulus port 27, the stop shoulders 47, 49 will contact each other. The protector sleeve 43 will not be able to move upward any higher. The hydraulic pressure, however, will still be moving the closure sleeve 35 upward. This causes the closure sleeve 35 to separate from the protector sleeve 43. When the closure sleeve 35 reaches its uppermost position, the lower edge 41 will be aligned with the upper edge of the annulus port 27. The extension sleeve hole 52 will be aligned with the annulus port 27. The lower edge 41 of the closure sleeve 35 will be separated from the upper edge 45 of the protector sleeve 43. Any pressurized fluid in the annulus will be free to flow through the annulus port 27 and passage 25 to the surface.

Figure 4:
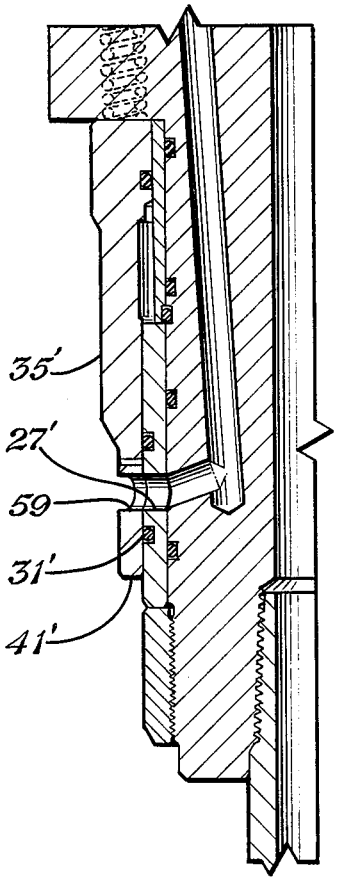
PRIOR ART Fig.4
FIG. 4 is a sectional view illutrating a prior art annulus valve.

FIG. 4 illustrates a prior art annulus valve. Closure sleeve 35' has a port 59 located above its lower edge 41'. The lower edge 41' does not slide above the lower O-ring 31'. The port 59 slides past the lower O-ring 31' when moving from the closed position (not shown) to the open position shown in FIG. 4. In the open position, the port 59 will align with the annulus port 27'.

While the invention has been shown in only one of its forms, it should be apparent to those skilled in the art that it is not so limited, but is susceptible to various changes without departing from the scope of the invention. For example, the closure sleeve and protector sleeve assembly could be inverted from that shown in the drawing, with the closure sleeve moving downward to the open position.

I claim:

1. In a well having a tubing hanger for supporting a string of tubing within casing, the tubing hanger having a lower exterior cylindrical portion, a passage extending from an upper end of the tubing hanger to a port on the cylindrical portion in communication with an annulus between the tubing and casing, an improved valve for selectively opening and closing the port, comprising in combination:

a closure sleeve slidingly mounted to the exterior of the cylindrical portion and having a lower edge;

means for moving the closure sleeve between a lower position in which the lower edge is below the port for blocking the port and an upper position in which the lower edge is above the port;

a protector sleeve slidingly mounted to the exterior of the cylindrical portion below the closure sleeve and having an upper edge, the upper edge of the protector sleeve being engaged by the lower edge of the closure sleeve to push the protector sleeve downward with the closure sleeve as the closure sleeve moves to the lower position;

means for urging the protector sleeve upward for causing the protector sleeve to move upward as the closure sleeve moves toward the upper position; and means for stopping upward movement of the protector sleeve before the upper edge of the protector sleeve passes the port and before the closure sleeve reaches the upper position, causing the lower edge of the closure sleeve to separate from the upper edge of the protector sleeve to expose the port to the annulus.

2. In a well having a tubing hanger for supporting a string of tubing within casing, the tubing hanger having a lower cylindrical portion, a passage extending from an upper end of the tubing hanger to a port on the cylindrical portion in communication with an annulus between the tubing and casing, a first annular seal around the cylindrical portion adjacent to and in a location a first direction from the port, a second annular seal around the cylindrical portion adjacent to and in a location a second direction from the port, an improved valve for selectively opening and closing the port, comprising in combination:

a closure sleeve slidingly mounted to the cylindrical portion and having an edge;

means for moving the closure sleeve in the second direction to a closed position engaging both of the annular seals and blocking the port and in the first direction to an open position in which the edge disengages from the second annular seal and clears the port;

a protector sleeve slidingly mounted to the cylindrical portion adjacent the closure sleeve and having an edge, the edge of the protector sleeve being engaged by the edge of the closure sleeve to push the protector sleeve in the second direction with the closure sleeve as the closure sleeve moves to the closed position;

an extension sleeve extending from the closure sleeve on the exterior of the protector sleeve, the extension sleeve having an interior recess, the extension sleeve being movable in first and second directions as the closure sleeve moves between the open and closed positions;

spring means for urging the protector sleeve toward the closure sleeve for causing the protector sleeve to move with the closure sleeve as the closure sleeve moves in the first direction toward the open position, and for causing the edge of the protector sleeve to slide over and engage the second annular seal as the closure sleeve disengages from the second annular seal; the spring means comprising:

a spring located in the recess, urging the edge of the protector sleeve into abutment with the edge of the closure sleeve;

stop means for stopping movement of the protector sleeve in the first direction before the edge of the protector sleeve passes the port and before the closure sleeve reaches the open position, for causing the edge of the closure sleeve to separate from the edge of the protector sleeve to expose the port to the annulus; the stop means comprising:

a shoulder on the tubing hanger; and a shoulder on the interior of the protector sleeve positioned to engage the shoulder on the tubing hanger for stopping said movement of the protector sleeve in the first direction.

3. In a well having a tubing having a tubing hanger for supporting a string of tubing within casing, the tubing hanger having a lower cylindrical portion, a passage extending from an upper end of the tubing hanger to a port on the cylindrical portion in communication with an annulus between the tubing ad casing, upper and lower annular seals mounted around the cylindrical portion above and below the port, an improved valve for selectively opening and closing the port, comprising in combination:

a closure sleeve slidingly mounted to the cylindrical portion and having a lower edge;

means for moving the closure sleeve downward to a closed position engaging both of the annular seals and blocking the port and upward to an open position in which the lower edge disengages from the lower annular seal and moves above the port;

a protector sleeve slidingly mounted to the cylindrical portion below the closure sleeve and having an upper edge, the upper edge of the protector sleeve being engaged by the lower edge of the closure sleeve to push the protector sleeve downward with the closure sleeve as the closure sleeve moves to the closed position;

an extension sleeve extending downward from the closure sleeve on the exterior of the protector sleeve, the extension sleeve being movable up and down as the closure sleeve moves up and down, the extension sleeve having an aperture positioned to align with the port when the closure sleeve is in the open position, the extension sleeve having an internal recess;

spring means including a coil spring mounted in the recess of the extension sleeve for urging the protector sleeve toward the closure sleeve for causing the protector sleeve to move upward as the closure sleeve moves upward toward the open position, and for causing the upper edge of the protector sleeve to slide over the lower annular seal as the closure sleeve disengages from the lower annual seal, the spring having upper and lower ends, both of which move upward as the closure sleeve moves to the open position;

a downward facing shoulder on the tubing hanger; and an upward facing shoulder on the interior of the protector sleeve positioned to engage the shoulder on the tubing hanger and stop upward movement of the protector sleeve at a point wherein the upper edge of the protector sleeve is no higher than the port and before the closure sleeve reaches the open position, causing the lower edge of the closure sleeve to move upward from the upper edge of the protector sleeve to expose the port to the annulus.

4. In a well having a tubing hanger for supporting a string of tubing within casing, the tubing hanger having a lower cylindrical portion, a passage extending from an upper end of the tubing hanger to a port on the cylindrical portion in communication with an annulus between the tubing and casing, upper and lower annular seals mounted around the cylindrical portion above and below the port, an improved valve for selectively opening and closing the port, comprising in combination:

a closure sleeve slidingly mounted to the cylindrical portion and having a lower edge;

means for moving the closure sleeve downward to a closed position engaging both of the annular seals and blocking the port and upward to an open position in which the lower edge disengages from the lower annular seal and moves above the port;

a protector sleeve slidingly mounted to the cylindrical portion below the closure sleeve and having an upper edge, the upper edge of the protector sleeve being engaged by the lower edge of the closure sleeve to push the protector sleeve downward with the closure sleeve as the closure sleeve moves to the closed position;

an extension sleeve extending downward from the closure sleeve on the exterior of the protector sleeve and spaced from a portion of the exterior of the protector sleeve, defining a recess;

a spring located in the recess urging the upper edge of the protector sleeve in abutment with the lower edge of the closure sleeve, causing the protector sleeve to move upward as the closure sleeve moves upward toward the open position, and causing the upper edge of the protector sleeve to slide over the lower annular seal as the lower edge of the closure sleeve disengages from the lower annular seal;

a downward facing shoulder on the tubing hanger; and an upward facing shoulder on the interior of the protector sleeve positioned to engage the shoulder on the tubing hanger and stop upward movement of the protector sleeve at a point wherein the upper edge of the protector sleeve is no higher than the port and before the closure sleeve reaches the open position, causing the lower edge of the closure sleeve to move upward from the upper edge of the protector sleeve to expose the port to the annulus.

* * * * *

UNITED STATES PATENT OFFICE

CERTIFICATE OF CORRECTION

Patent No. 4,848,457 Dated July 18, 1989

Inventor(s) Lilley

It is certified that error appears in the above-identified patent and that said Letters Patent is hereby corrected as shown below:

Column 5, Line 52, "ad" should be--and--;

Column 6, Line 18, "annual" should be--annular--.

Signed and Sealed this

Third Day of July, 1990

*Attest:*

HARRY F. MANBECK, JR.

*Attesting Officer*

*Commissioner of Patents and Trademarks*